US006837495B2

(12) United States Patent
Gerson et al.

(10) Patent No.: US 6,837,495 B2
(45) Date of Patent: Jan. 4, 2005

(54) ELECTRONICALLY INTERACTIVE TARGET GAME

(76) Inventors: Joanne Gerson, 7714 Stonehenge Dr., Cincinnati, OH (US) 45242; Charles A. Cummings, 5719 Tomaridge Dr., Cincinnati, OH (US) 45248

( * ) Notice: Subject to any disclaimer, the term of this patent is extended or adjusted under 35 U.S.C. 154(b) by 351 days.

(21) Appl. No.: 10/093,287

(22) Filed: Mar. 7, 2002

(65) Prior Publication Data

US 2003/0168811 A1 Sep. 11, 2003

(51) Int. Cl.[7] ..... F41J 5/02; A63B 63/08

(52) U.S. Cl. ..... 273/372; 273/108.3; 473/476; 473/481

(58) Field of Search ..... 473/476, 467, 473/409, 412, 192, 154, 151, 371–372, 365, 369, 359, 345.4, 317.6, 317.5, 455–456, 156, 431, 422, 415; 273/372, 371, 369, 365, 359, 348.4, 317.6, 317.5

(56) References Cited

U.S. PATENT DOCUMENTS 4,199,141 A * 4/1980 Garcia ..... 473/455
4,830,369 A * 5/1989 Poitras ..... 473/455
5,419,549 A * 5/1995 Galloway et al. ..... 473/431
5,509,649 A * 4/1996 Buhrkuhl ..... 473/455
5,566,934 A * 10/1996 Black et al. ..... 473/431
5,658,211 A * 8/1997 Glover ..... 473/422
5,820,496 A * 10/1998 Bergeron ..... 473/455
5,836,588 A * 11/1998 Gerson ..... 273/348.4
5,908,194 A * 6/1999 Schachter et al. ..... 273/372
6,551,205 B1 * 4/2003 Koelzer et al. ..... 473/454
6,565,449 B2 * 5/2003 Buhler ..... 473/151
6,595,878 B1 * 7/2003 Nelson ..... 473/476

* cited by examiner

*Primary Examiner*—Jessica Harrison
*Assistant Examiner*—Alex F. R. P. Rdad, II
(74) *Attorney, Agent, or Firm*—Dwight A. Stauffer

(57) ABSTRACT

An Electronically Interactive Target Game to be played indoors by children, wherein the target is a flexible sheet hung on a wall or attached to a portable stand; and has mural-like artwork on the sheet portraying characters playing an action sport. A projectile corresponding to the portrayed sport is thrown at the target. Selected area rigid surfaces, each with a sensor, are attached behind selected areas of the sheet and, when struck, activate audible and visual signals that relate to the success of the child hitting the selected areas to facilitate the fantasy of actually playing a game with the characters in the artwork. A vibration sensor may be attached to the target sheet to detect contact of the projectile with the rest of the target outside of the selected areas. Hook and loop material may be used on the ball and on a selected area (e.g., mitt).

23 Claims, 3 Drawing Sheets

ELECTRONICALLY INTERACTIVE TARGET GAME

TECHNICAL FIELD OF THE INVENTION

The present invention relates generally to a projectile-and-target game and is particularly directed to a combination game and mural which rewards contact of the projectile with the target with audible and/or visual feedback that can include a spoken phrase, a buzzer and a scoreboard to simulate playing a sport.

BACKGROUND OF THE INVENTION

Children enjoy pitching, throwing, kicking and swinging at balls especially if the ball bounces back for more practice. Often times they engage in these physical activities indoors where they can be harmful to themselves or their surroundings. A few safe indoor target games have been developed but they are not selling well in today's toy market when these simple target toys are competing with fancy electronic toys. The result is the problem of the child practicing indoors with outdoor equipment not safe for indoor use. Furthermore, parents and children enjoy decorating the children's bedroom or playroom with agreeable artwork that will not mar the wall or door.

U.S. Pat. No. 3,941,383 (Clarke), issued Mar. 2, 1976 discloses a sports-related target game with a printed baseball player on the target. The target must be attached to the wall with a nail or screw hook or other similar object that will mar the wall. Clarke shows a knit nylon and urethane foam wall-hanging target having a loop threaded material, and a ball partially covered by the hook-threaded fastening materials. The loop-threaded and hook-threaded fastening materials are known as VELCRO™. The hook fabric on the ball causes lint to stick to it and also causes the ball to get caught in other toys or material found in the child's room.

The present applicant solved many of the inherent problems in prior art target games in the U.S. Pat. No. 5,836,588 (Gerson) issued Nov. 17, 1998. The sports related target game is printed on a self-adhesive mural portraying characters playing an action sport, a loop-threaded stuffed ball corresponding to the sport portrayed in the mural, and a hook threaded fabric target attached to the mural in an appropriate location to facilitate the fantasy of actually play in a game with the figures on the wall mural. The ball is covered in the loop-threaded fabric that does not stick to common material or surfaces found in a child's room or play area. The mural is decorative and enhances the appearance of the child's room. The child can continue play for unlimited time either alone or with friends. The challenge for the child is to get the ball to stick on the mural in the section that is covered with the loop-threaded material. This creates a feeling of instant success. The artwork on the mural engages the child's imagination so that pretending to be the pitcher, soccer forward or quarterback for example, encouraging fun role playing activities. However, this game could be enhanced with audible and visual sound effects to produce an even more exciting game.

Many toy inventors realized the limits of selling the simple target game in the competitive market arena. Prior art electronic target games tend to be complicated to produce and cumbersome for the owner.

For example, U.S. Pat. No. 5,358,253 (Chen), issued Nov. 4, 1994, describes a light and sound emittable darts-board. In this invention the electronics are bulky and the board must be hung on the wall on a nail, screw, hook or other similar object that will mar the wall. There are three layers used to create the necessary space for the electronics. Thus the target is heavy and must be securely fastened to the wall for safety. The inventor has adults in mind when creating this dart game to be used in bars as he suggests. The theme is limited to simple darts and a target that does not invite a child to use his imagination as one could in a sports-play mural.

U.S. Pat. No. 5,326,094 (Quinn), issued Jul. 5, 1994, describes an audio sports game that utilizes audio messages to present a functional setting for the person playing the game. In order for the mechanism to trigger an audio message, an object must pass through a 3D structure and hit a mechanical switch as it passes through. To mass-produce a 3D object is more expensive than to mass-produce a 2D surface with a mural creating the illusion of a 3D scene that is printed on the front surface. Also, a mechanical switch has a relatively short life span.

U.S. Pat. No. 5,566,934 (Black, et al.), issued Oct. 22, 1996, describes a baseball trainer that includes a free-standing target apparatus having a plurality of panels for indicating a "strike" or a "ball", which indication is communicated to a microcomputer in a console adjacent to the practicing player. Additional features allow the trainer to calculate pitching speed and to audibly report it to the player. Black's trainer is a complicated and expensive apparatus designed for rugged commercial use, therefore not appropriate for the cost-competitive consumer toy market. Referring to Black's FIG. 4, a limitation of its design can be seen in that a strike panel (22) and ball panel (34) are mounted separately from each other, suspended on double hinges (23, 25) from a back panel (26). The panels register a hit by a ball (B) providing the hit has sufficient impact to move the panel enough to compress a spring (28, 31, 32) and a switch (27, 29, 30) that are both positioned between the strike or ball panel and the back panel. The ball panel surrounds the strike panel and is therefore rather large. According to Black's detailed description: " . . . it is advisable to mount more switches (29, 30) at divers locations behind the 'ball' zone panel (24), because of its larger size, to ensure that a ball hitting anywhere on the 'ball' zone panel (24) will result in a signal."

SUMMARY OF THE INVENTION

Electronically Interactive Target Game is a game to be played indoors by one or more children, the game comprising a target being a flexible sheet hung on a wall or attached to a portable stand; mural-like artwork on the sheet portraying characters playing an action sport; a projectile being a stuffed ball corresponding to the sport portrayed in the artwork; and sensors comprising pressure sensitive electrical switches attached behind the sheet and located in selected areas which, when struck, activate a feedback signals such as a voice heard through a speaker. The voice says phrases that relate to the success or failure of the child bitting the selected areas to facilitate the fantasy of actually playing a game with the characters in the artwork. Optionally, an LCD or a colored LED alphanumeric display may indicate numerical scores. A vibration sensor may be attached to the target sheet to detect contact of the projectile with a non-selected area being the rest of the target outside of the selected areas. Contact with the non-selected area is assumed if the vibration sensor is activated while none of the pressure sensitive sensors are detecting contact with any of the selected areas. The game encourages creative role playing, physical skill improvement, and physical exercise including pitching, throwing, kicking, running and jumping.

Accordingly, it is an object of the present invention to improve on the prior art by providing a simpler, more cost effective construction that also overcomes performance limitations of the prior art.

According to the invention, a game is disclosed comprising a projectile, being a free object; and a target, comprising a flexible sheet, mountable on a whole-area rigid surface wherein: the sheet has a front side and a back side; the front side comprises mural-like artwork illustrating a scene that has one or more selected areas related to scoring or other actions of the game, the selected areas being portions of a total area of the sheet; attached to the sheet are one or more selected area rigid surfaces that are shaped correspondingly to the one or more selected areas, each of the one or more selected area rigid surfaces being positioned within a corresponding one of the one or more selected areas; a sensor is attached behind each of the one or more selected area rigid surfaces; a display is associated with the target; and circuitry connects each sensor and the display with a processor having preprogrammed software such that when the projectile contacts one of the one or more selected areas, the display responds with feedback signals that are appropriate to the actions of the game.

According to the invention, the game is further characterized in that: the sensor attached behind one of the one or more selected area rigid surfaces detects when the projectile contacts the corresponding selected area by being compressed between the one of the one or more selected area rigid surfaces and the whole-area rigid surface. Preferably, the game is further comprising: a non-selected area of the sheet being a portion of the total area that is outside of all of the one or more selected areas; a vibration sensor attached to the non-selected area and connected to the circuitry such that when the projectile contacts the non-selected area, the vibration sensor detects vibration resulting from the contact, and the display responds with feedback signals that are appropriate to the actions of the game; and if the vibration sensor detects vibration concurrently with compression of the sensor attached to the back of one of the one or more selected area rigid surfaces, then the vibration sensor is ignored and the display responds with feedback signals that are appropriate for an occurrence of the projectile contacting one of the one or more selected areas corresponding to the one of the one or more selected area rigid surfaces.

According to the invention, the game is further comprising: a non-selected area of the sheet being a portion of the total area that is outside of all of the one or more selected areas; and a vibration sensor attached to the non-selected area and connected to the circuitry such that when the projectile contacts the non-selected area, the vibration sensor detects vibration resulting from the contact, and the display responds with feedback signals that are appropriate to the actions of the game.

According to the invention, the game is further characterized in that the feedback signals may be audible sounds which inform a player about a game-related consequence of the projectile contacting one of the one or more selected areas. Optionally, the audible sounds may be spoken words and/or the buzz of a buzzer.

According to the invention, the game is further characterized in that the feedback signals may be visual effects which inform a player about a game-related consequence of the projectile contacting the target. Optionally, the visual effects may be a scoreboard display with numeric scores.

According to the invention, the game is further characterized in that there is a home team and an away team; when the projectile contacts any one of a first subset of the one or more selected areas, then points are scored for the home team; when the projectile contacts any one of a second subset of the one or more selected areas, then points are scored for the away team; and the feedback signals that are displayed include a scoreboard display with numeric scores for the home team and the away team.

According to the invention, the game is further characterized in that the feedback signals are displayed at a predetermined time interval after the projectile contacts one of the one or more selected areas.

According to the invention, the game is further characterized in that for each one of the one or more selected areas, when contacted by the projectile, a specific feedback signal is displayed that is unique to the one of the one or more selected areas.

According to the invention, the game is further characterized in that for each one of the one or more selected areas, when contacted by the projectile, a specific feedback signal is displayed such that the specific feedback signal is selected from a bank of feedback signals according to a predetermined sequential pattern.

According to the invention, the game is further characterized in that the feedback signals include simulated sounds of fireworks exploding; and the sounds can be used to indicate the conclusion of a time of playing the game.

According to the invention, the game is further characterized in that the display is attached to the perimeter of the target.

According to the invention, the game is farther characterized in that the scene depicts a sport that involves a projectile. Optionally, the scene depicts at least one character associated with the sport. Optionally, the projectile simulates a projectile chosen from the group consisting of a baseball, a football, a basketball, a soccer ball, a tennis ball, a table tennis ball, a golf ball, and a hockey puck.

According to the invention, the game is further characterized in that the projectile is made safe for indoor play.

According to the invention, the game is further characterized in that at least a portion of the back side of the sheet has adhesive material thereon, for mounting the target on the whole-area rigid surface; the whole-area rigid surface is a wall; and the adhesive material removably adheres to the wall without additional fasteners and without damaging the wall.

According to the invention, the game is further characterized in that at least a portion of the back side of the sheet has adhesive material thereon, for mounting the target on the whole-area rigid surface; and the whole-area rigid surface is a stiff portable surface that is either hand held or free standing.

According to the invention, the game is further characterized in that the sheet comprises a first layer having a first planar area, and a second layer having a second planar area; the first planar area is larger than the second planar area; the first layer has an adhesive backing; and the second layer is adhered to the adhesive backing such that a portion of the adhesive backing around the perimeter of the second layer is uncovered by the second layer, thereby providing a means for mounting the target on the whole-area rigid surface. Optionally, the second layer is a flexible material having the artwork on the side adhered to the adhesive backing of the first layer.

According to the invention, the game is further characterized in that the projectile is at least partly covered with a first attachment means; and at least a portion of the front side of the sheet is covered with a second attachment means that matingly corresponds to the first attachment means. Preferably the first attachment means is loop-threaded material and the second attachment means is hook-threaded material. Preferably the second attachment means covers an area within one of the one or more selected areas.

According to the invention, the game further comprises an on-off switch, wherein while the on-off switch is switched on, the game functions automatically such that: contacting the target causes the display to be active, and begins a game sequence if the game was in a sleep mode prior to the target being contacted; and after a predetermined game score, or at a predetermined time period following a most recent contact of the target, the game automatically changes into the sleep mode wherein the display is inactive and the game sequence is assumed to be completed.

According to the invention, a method is disclosed of providing feedback to a player of a projectile-and-target game, the method comprising: constructing the target from a flexible sheet; applying mural-like artwork to a front side of the sheet for illustrating a scene that has one or more selected areas related to scoring or other actions of the game, the selected areas being portions of a total area of the sheet; associating at least one of one or more first sensors with each of the one or more selected areas for detecting contact of the projectile with a contacted one of the one or more selected areas; associating a second sensor with the sheet such that the second sensor can detect vibration of the sheet whenever the sheet is contacted by the projectile; responding with feedback indicating that the projectile has contacted the contacted one of the one or more selected areas whenever one of the one or more first sensors detects contact with the contacted one of the one or more selected areas; and responding with feedback indicating that the projectile has contacted a portion of the total area that is outside of all of the one or more selected areas whenever the second sensor detects vibration of the sheet while none of the one or more first sensors are detecting contact with any one of the one or more selected areas.

Other objects, features and advantages of the invention will become apparent in light of the following description.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

The structure, operation, and advantages of the present preferred embodiment of the invention will become further apparent upon consideration of the following description taken in conjunction with the accompanying drawings, wherein.

DETAILED DESCRIPTION OF THE INVENTION

Figure 2:
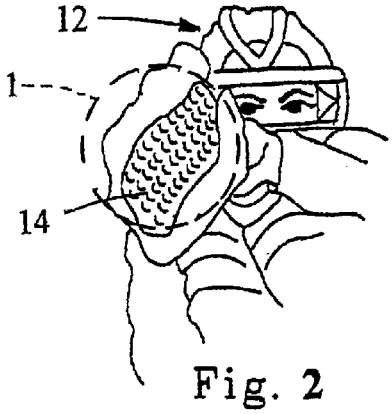
FIG. 2 is an enlarged view of a portion of the target of FIG. 1, showing a second attachment means and a first selected area of the target, according to the invention.
Figure 3:
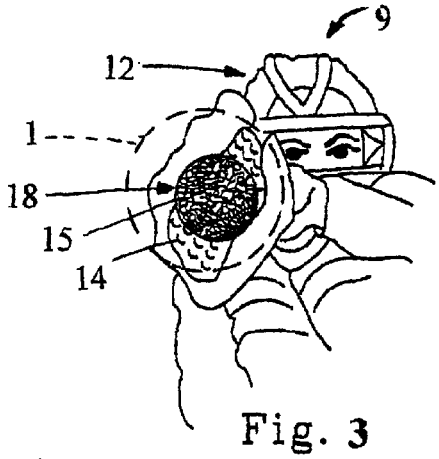
FIG. 3 is the enlarged view of a portion of the target of FIG. 2, showing a projectile attached to the target by means of a first attachment means on the projectile, according to the invention.
Figure 1:
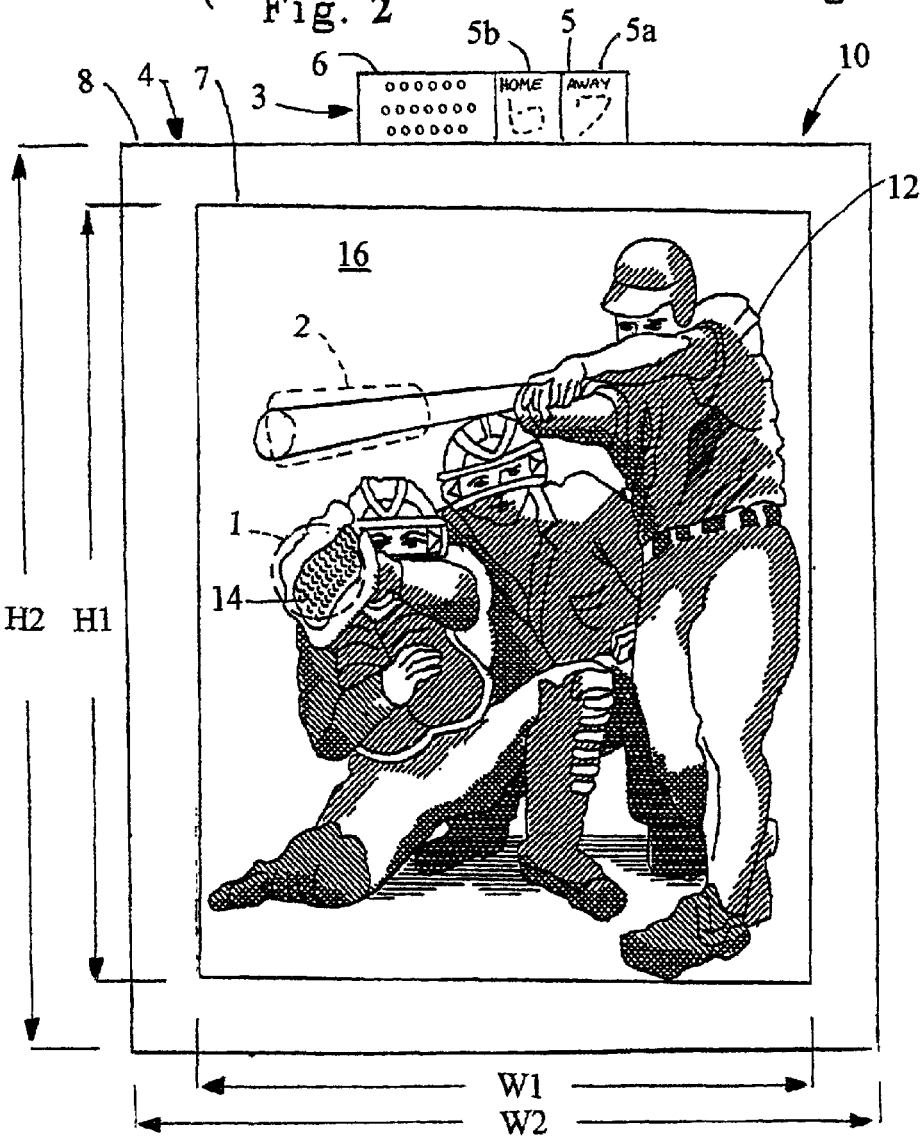
FIG. 1 is a front view of a target, according to an embodiment of the invention.

FIGS. 1–3 are front views of a game 9, also referred to as an "Interactive Target Toy", comprising a game system having a projectile 18 and a target 10. Artwork 12 on the target 10 may, for example, depict a simple bull's-eye, but preferably illustrates a scene of an active sport game that involves a projectile 18, the sport game being, for example, but not limited to: baseball, soccer, football, basketball, soccer, tennis, table tennis, golf, or hockey. A preferred embodiment of the invention is illustrated in the drawings with artwork 12 depicting a scene from a baseball game. In particular, the artwork 12 of the preferred embodiment illustrates a catcher, umpire, and batter, so that a player (not shown) of the game 9 can play the role of a pitcher pitching the projectile 18, that would suitably simulate a baseball or a softball. Preferably, the projectile 18 is made safe for indoor play.

The artwork 12 is illustrated as a mural printed on a sheet 4 comprising a flexible material (fabric) such as, but not limited to, vinyl or cloth. The target 10 and projectile 18 may incorporate many of the concepts disclosed in the U.S. Pat. No. 5,836,588 of interactive wall art that is summarized in the background section hereinabove, and incorporated in its entirety by reference herein. For example, the mural depicts a scene preferably including at least one character associated with the depicted sport. For example, the projectile (ball) 18 is optionally at least partly covered with a first attachment means 15 that matingly corresponds with a second attachment means 14 optionally covering a suitable portion of the target 10. As illustrated for the preferred embodiment in FIGS. 1–3, the second attachment means covers a pocket portion of the catcher's mitt, thereby defining a preferred spot for contacting with a "pitched" ball 18, since an accurate pitch (presumably a "strike") is both indicated and rewarded when the ball 18 contacts and adheres to the catcher's mitt due to the mating first attachment means 15 and second attachment means 14. Preferably the first attachment means 15 comprises a loop-threaded material (e.g., Velcro™) and the second attachment means 14 comprises a matingly corresponding hook-threaded material (e.g., Velcro™). When Velcro™ or a similar mating fabric system is used, the preferred placement of the hook-threaded material on the target sheet 4 and the loop-threaded material on the projectile 18 enables the projectile 18 to remain lint free and to be more comfortable to hold than if the rough surface of the hook-threaded material covered the projectile 18. The use of the mating first and second attachment means 15, 14 provides a limited form of feedback to a player of the game. An advantage of the present invention is enhanced game play due to features described hereinbelow that provide more extensive game-appropriate feedback signals to the player, including, for example, audible and/or visual signals such as spoken results, scoreboard scores and sound effects.

Figure 4:
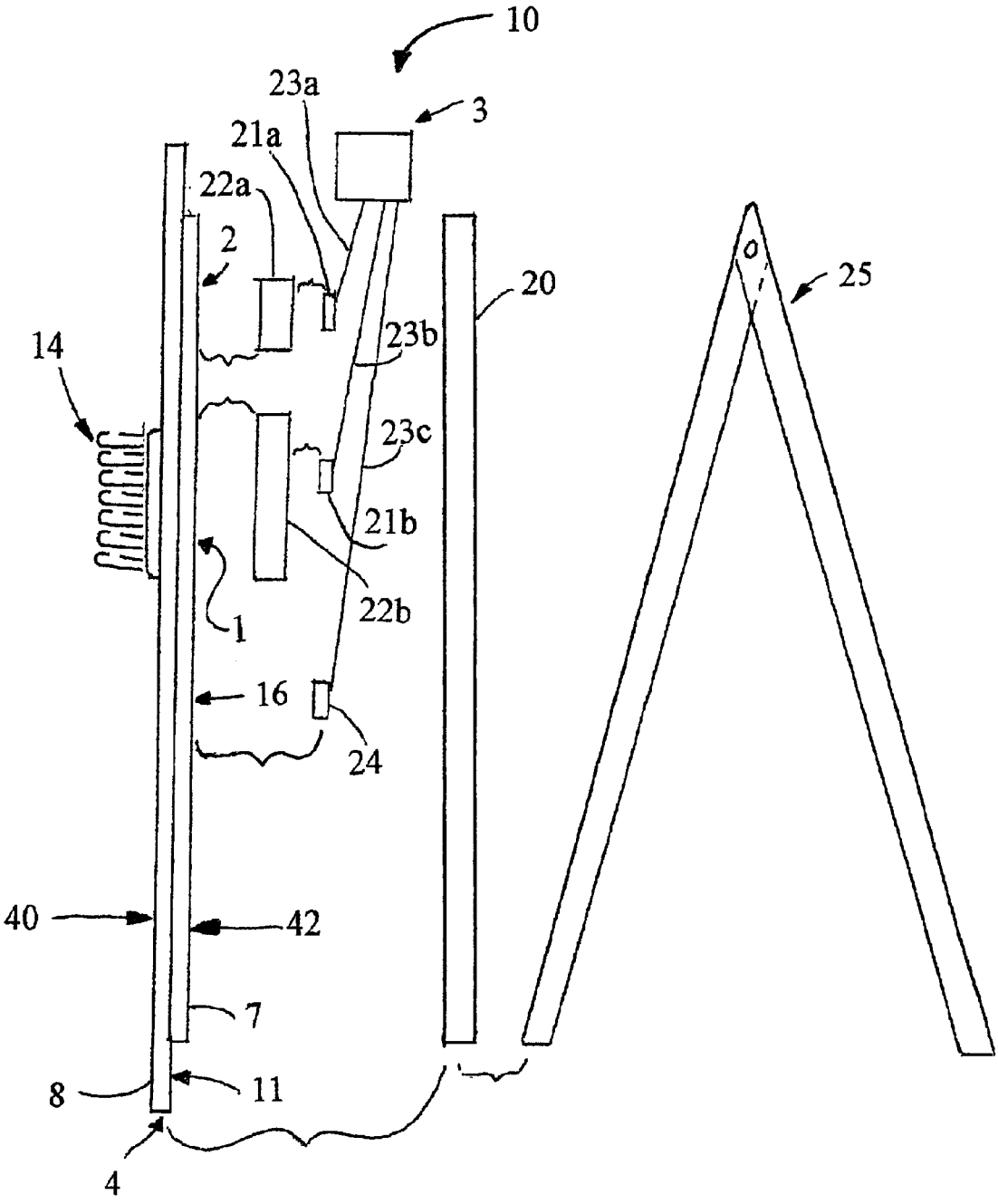
FIG. 4 is a side, exploded view of the target of FIG. 1 and a whole-area rigid surface with an optional stand for mounting the target, according to the invention.

Referring to the front view of FIGS. 1–3 and also the side view of FIG. 4, the target 10 is attached to a whole-area rigid surface 20 such as a wall or a freestanding, portable rigid surface (e.g., corrugated board, foam board). An optional stand 25, for example an easel, is provided to make the whole-area rigid surface 20 freestanding. It is within the scope of the invention that the target 10 is attached to a whole-area rigid surface 20 that is a size and shape suitable for being hand held. For example, the target 10 could be shaped as a hockey goalie that would be moved by a second player. It will be seen that the whole-area rigid surface 20 performs an important function for the game 9, and therefore the whole-area rigid surface 20 can be considered a part of the target 10, even though games 9 having targets 10 that are designed to be mounted on a wall (e.g., a wall of a house) could obviously be sold without the rigid surface 20. A purchaser of a wall-mountable embodiment of the game 9 would therefore supply a component of the target 10 (a wall 20) much as he would supply batteries needed to make electronic toys function.

Referring to FIGS. 1 and 4, a preferred embodiment of the inventive target 10 comprises a sheet 4 having a front side 40 and a back side 42. The sheet 4 preferably comprises two layers of flexible material: a fabric layer 7 and an adhesive layer 8. The adhesive layer 8 has an adhesive material 11 as backing such that the fabric layer 7 is adhered to the adhesive layer 8 to form a single sheet 4. The adhesive layer 8 has a planar area that is larger than the planar area of the fabric layer 7, and the fabric layer 7 is preferably positioned on the adhesive layer 8 such that an area forming a perimeter around the sheet 4 has adhesive material 11 on the back side 42 of the sheet 4. For example, the rectangular embodiment of the sheet 4 of the target 10 has overall dimensions of width W2 by height H2, as determined by the corresponding dimensions of the adhesive layer 8, whereas the fabric layer 7 has dimensions of width W1 by height H1 such that the width W1 is less than the width W2 and the height H1 is less than the height H2. It is within the scope of the invention to construct the sheet 4 using a single layer such as the fabric layer 7 and to apply adhesive material 11 to at least a portion of the back side 42 of the sheet 4. The adhesive material 11 can be a low pressure adhesive or glue to allow for removably (repositionably) mounting the sheet 4 onto a wall (whole area rigid surface 20) without the need for additional fasteners. Alternatively, the adhesive material 11 can be a permanent glue or even mechanical fasteners (e.g., staples, nails, hooks, hook-and-loop material). The more permanent adhesive materials 11 are preferably used to attach the sheet 4 to a whole area rigid surface 20 that is provided as a part of the game 9, in which case the whole area rigid surface 20 is preferably made with the same overall dimensions as the fabric layer 7 (e.g., W1 by H1) so that the perimeter of the adhesive layer 8 can be wrapped around the edges of the whole area rigid surface 20. As will be learned from the description hereinbelow, the location of the adhesive material 11 on the sheet 4 is important for the functioning of certain aspects of the invention.

Given the teaching of the present invention, one of ordinary skill will discern a variety of combinations, all considered within the scope of the invention, of artwork 12 application methods, and of materials for the sheet 4, the adhesive layer 8 and the fabric layer 7. An example, not to be considered limiting, is to screen print the artwork 12 on the front of the fabric layer 7 (e.g., made of paper) and to apply the adhesive layer 8 (being a clear vinyl, adhesive 11 backed material) over the front of the fabric layer 7. Another example is to print some or all of the artwork 12 on the front side 40 of the sheet 4. These two examples could be combined such that a portion of the artwork 12 is printed on the front of the fabric layer 7, and another portion of the artwork 12 is printed on the front of the adhesive layer 8, the adhesive layer 8 preferably being transparent. Thus the term "portion of the artwork 12" should be understood to include anywhere from all to none of the artwork 12.

Figure 5:
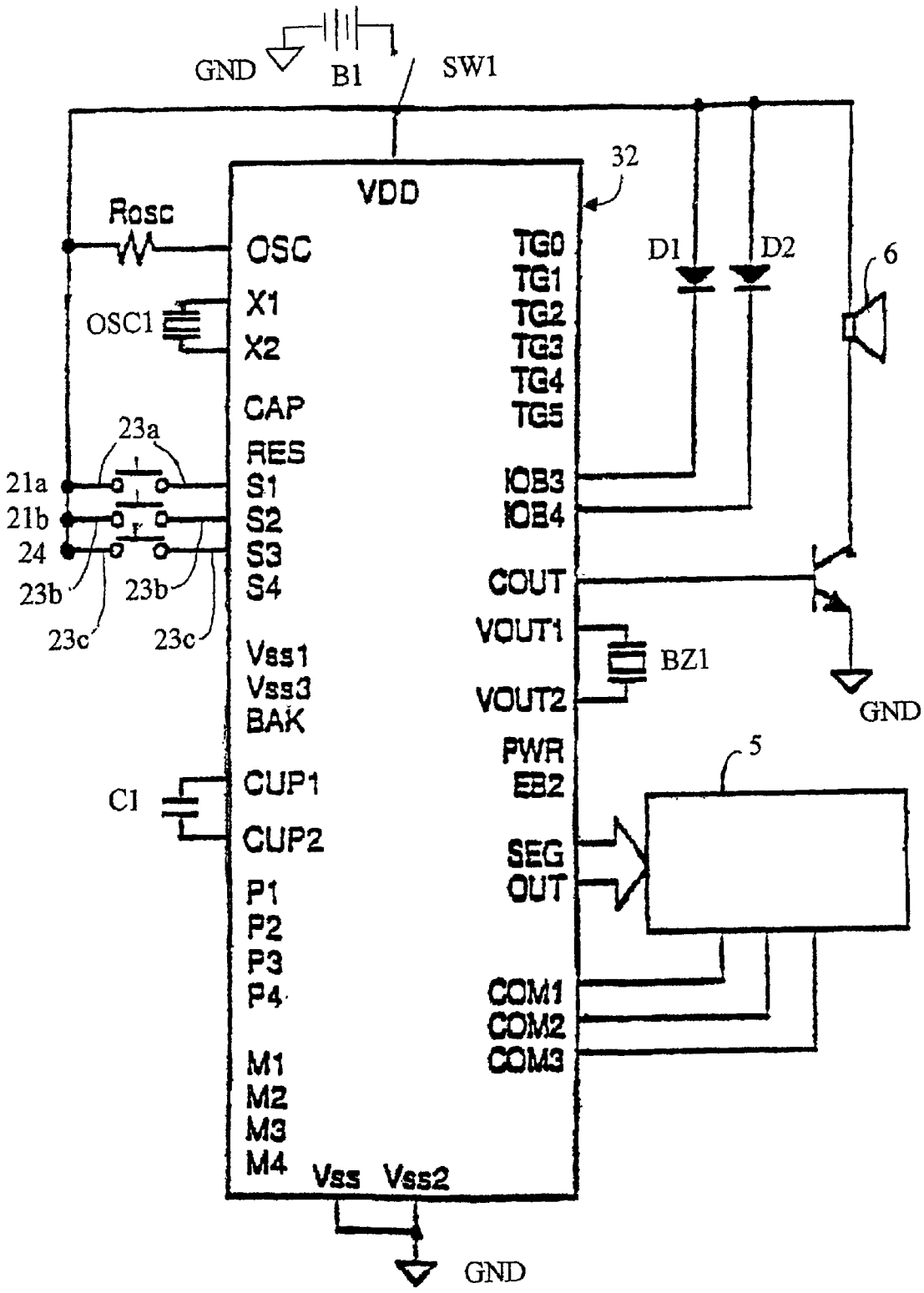
FIG. 5 is a schematic diagram of circuitry for the target of FIG. 1, according to the invention.

In order to provide enhanced feedback signals to a player of the inventive game 9, electronic circuitry 30 is provided for sensing contact of the projectile 18 with various portions of a total area of the target 10, and then for responding with feedback signals that are appropriate to actions of the game. Feedback signals include: audible sounds, for example a buzzer sound, playback of spoken words (e.g., a recorded spoken phrase); and/or visual effects, for example a score change on an alpha-numeric display. A display 3 is associated with the target 10, and the circuitry 30 connects the display 3 with a processor 32 (e.g., a microprocessor 32 as shown in FIG. 5) having preprogrammed software for controlling the actions of the game 9. The display 3 is preferably attached to the perimeter of the target 10, but could be placed anywhere (e.g., sitting on the floor below a wall-mounted target 10). The display 3 comprises suitable elements such as a speaker 6 for displaying audible feedback signals, and an alphanumeric display 5 for displaying visual feedback signals. For example, the display 3 in FIG. 1 illustrates an alphanumeric display 5 having two labeled portions for displaying a "home" team score (display portion Sb) and an "away" team score (display portion 5*a*).

For the embodiment illustrated in FIG. 1 (a baseball game), a ball 18 contacting a first 30 selected area 1 (a catcher's mitt, the selected area indicated by a dashed outline) could be considered a pitched "strike" and, if sensed, could trigger appropriate feedback such as the sound of an umpire calling the word, "strike" and/or a visual display of the total number of strikes and resulting outs. Optionally, a second selected area 2 (along a portion of a bat, the selected area indicated by a dashed outline) could be formed such that sensing the ball 18 contacting the second selected area 2 could trigger appropriate feedback such as the sound of an announcer saying "it's a hit" and/or a visual display of the total number of hits and resulting scores. Any number of selected areas 1, 2 could be formed as appropriate for game play. For example, additional portions of the bat could form additional selected areas (not shown) which, when contacted by the projectile 18, could be considered as a pitch that would result in a foul ball (e.g., contacting the handle of the bat). A feature of the present invention is the ability to optionally, simply, and cost-effectively detect contact of the projectile 18 with a non-selected area 16 of the sheet 4 that comprises substantially any portion of the total area of the fabric layer 7 that is outside of all of the one or more selected areas 1, 2. The detection of contact of the projectile 18 with the non-selected area 16 allows the game 9 to detect "misses". For example, in the context of the baseball game illustrated in FIG. 1, the miss can be considered a pitched "ball" and, if sensed, could trigger appropriate feedback such as the sound of an umpire calling the word, "ball" and/or a visual display of the total number of balls and resulting walks.

FIG. 4 is a side view illustrating assembly of the target 10. Attached to the back side 42 of the sheet 4 are one or more selected area rigid surfaces 22*a*, 22*b* (collectively referred to as 22) that are shaped correspondingly to the one or more selected areas 1, 2 and attached in back of (behind) a corresponding one of the one or more selected areas 1, 2. For example, a first selected area rigid surface 22*b* is attached behind the first selected area 1 and is shaped correspondingly to the first selected area 1. For example, a second selected area rigid surface 22*a* is attached behind the second selected area 2 and is shaped correspondingly to the second selected area 2. It will be seen from the disclosure hereinbelow that the selected area rigid surfaces 22 effectively determine the shape and area of the selected areas 1, 2; and that the attachment location of each of the selected area rigid surfaces 22 effectively determines the location of each of the selected areas 1, 2. The selected area rigid surfaces 22 are preferably made of lightweight, thin but relatively inflexible materials such as, for example, corrugated board or foam board. The selected area rigid surfaces 22 are attached by conventional means. It is within the scope of the invention that the selected area rigid surfaces 22 can be attached on any of the surfaces of the sheet 4 and its optionally multiple layers (e.g., 7 and 8). For example, the selected area rigid surfaces 22 could be sandwiched between the fabric layer 7 and the adhesive layer 8. For example, the selected area rigid surfaces 22 could be attached to the front side 40 of the sheet 4, thereby forming part of the front side 40 of the target 10, in which case an appropriate portion of the artwork 12 may be applied on the selected area rigid surfaces 22.

A sensor 21*a*, 21*b* (collectively referred to as 21) is attached behind each of the one or more selected area rigid surfaces 22*a*, 22*b* respectively. The sensors 21 are preferably pressure-sensing switches (e.g., a micro-switch) that change state in response to pressure resulting when the projectile 18 contacts a selected area 1, 2 thereby compressing the sensor 21 between the selected area rigid surface 22*a*, 22*b* (collectively referred to as 22) and the whole-area rigid surface 20. The sensors 21*a* and 21*b* are electrically connected as part of the circuitry 30 by sensor wires 23*a* and 23*b*, respectively, that preferably run between each sensor 21 and the display 3, which preferably contains other elements of the circuitry 30, including the processor 32. The sensors 21 preferably comprise a momentary action single pole switch, and the sensor wires 23*a*, 23*b* (collectively referred to as 23) preferably comprise at least a pair of wires for sensing the state of the switch. The circuitry 30 will be further described hereinbelow.

In addition to the one or more sensors 21 for detecting contact of the projectile 18 with the one or more selected areas 22, the preferred embodiment of the inventive target 10 has a vibration sensor 24 attached to the non-selected area 16 of the target 10 and connected to the circuitry 30 (by means of sensor wires 23*c*) such that when the projectile 18 contacts the non-selected area 16, the vibration sensor 24 detects vibration resulting from the contact, and the display 3 responds with feedback signals that are appropriate to the actions of the game 9. To enable vibration of the sheet 4 in the non-selected area 16, the fabric layer 7 (being the portion of the sheet 4 that does not have adhesive material 11 on the back side 42) remains free to bounce or vibrate against the whole area rigid surface 20. The vibration sensor 24 is preferably a motion detector that momentarily closes a single pole switch whenever it detects motion (vibration). The vibration sensor 24 is electrically connected as part of the circuitry 30 by sensor wires 23*c* that preferably run between the vibration sensor 24 and the display 3, and the sensor wires 23*c* preferably comprise at least a pair of wires for sensing the state of the switch in the vibration sensor 24.

When the vibration sensor 24 is included in the target 10, an important element of a controlling program in the processor 32 is logic that allows the processor to distinguish between vibration caused by hits on the non-selected area 16 and vibration caused by hits on a selected area 1, 2. The logic featured in the present invention is to ignore vibration sensor 24 detections whenever one of the sensors 22 is concurrently detecting pressure on a selected area 1, 2—thereby using the 30 sensors 22 to indicate which of the one or more selected areas 1, 2 have been contacted (presumably by the projectile 18). Furthermore, if the vibration sensor 24 detects vibration while the sensors 22 are not detecting pressure, then the processor concludes that the non-selected area 16 has been contacted (presumably by the projectile 18) and responds with suitable feedback signals. In other words, switch closings in the sensors 22 associated with selected areas 1, 2 are given a higher priority than switch closings in the vibration sensor 24 associated with the non-selected area 16. This logic can be extended to give priority rankings to the sensors 22 when there are more than one sensor 22 present, thereby providing game-appropriate responses when two or more sensors 22 are simultaneously contacted (e.g., for two selected areas 1, 2 that are very close together). For example, the sensor 21*b* behind the first selected area 1 can be given priority over the sensor 21*a* behind the second selected area 2, such that if both selected areas 1, 2 are contacted by the projectile 18 (ball), then the processor will respond as if only the first selected area 1 has been hit.

As described hereinabove, the feedback signals emitted by the display 3 can include spoken phrases. The spoken phrases are preferably accomplished by means of software programmed within a small, dedicated speech synthesizing computer chip connected to a speaker 6. In a preferred mode of operation, when each one of the selected areas 1, 2 or the non-selected area 16 are impacted by the projectile 18 a spoken phrase is selected from a preprogrammed bank of phrases associated with the particular area 1, 2, 16 that has been impacted. The selection is performed according to a predetermined sequential pattern, which could be random. There can be a predetermined delay time between impact and the emission of feedback signals. After a predetermined score level or predetermined time a victory sound, such as the noise heard from fireworks, may be emitted as the final score is announced. The game 9 will then reset the score-keeping to start a new game.

Three exemplary target games are described following a description of the circuitry 30.

Electronic Circuitry

FIG. 5 shows a schematic of the circuitry 30 used to implement the preferred embodiment of the inventive target 10. The circuitry 30 is built around a processor 32 such as an MSS$\mu$001, which is a commercially available microcomputer (microprocessor) made by Mosel Corporation of Taiwan. Standard components for the operation of the processor 32 include a voltage source, battery B1 (3.0 Volts DC) connected between ground GND and power input VDD. The ground GND connection to the processor 32 is made conventionally to Vss and Vss2 pins. An on-off switch SW1 is also provided between the battery and rest of the circuitry 30. A resistor Rosc and a clock oscillator crystal OSC1 are suitably valued and connected to OSC and X1–X2 pins of the processor 32. Similarly, a capacitor C1 (0.1 $\mu$f) is connected between CUP1–CUP2 pins, and diodes D1 and D2 (1N4001) are connected between VDD and IOB3, IOB4 pins, respectively. The optional speaker 6 (e.g., Radio Shack 8 ohm speaker #273-092) is connected from VDD through transistor T1 (2N8050) to ground GND. Output from the speaker 6 is controlled by a processor output COUT that is connected to the gate of the transistor T1. The optional piezo-electric buzzer BZ1 (e.g., Radio Shack #273-0653) is connected between pins VOUT1 and VOUT2. The optional alpha-numeric display 5 is, for example, a LCD 25 character by 3 line display, operating at ⅓ duty, ⅓ bias (e.g., Radio Shack #900-7603). The alpha-numeric display 5 is suitably connected to pins SEG OLTT, COM1, COM2, and COM3.

Of four switch inputs S1, S2, S3, and S4 for the processor 32, three are shown connected to the switches 21*a*, 21*b*, and 24 (illustrated in FIG. 4), also referred to herein as switches S1, S2, and S3, respectively. For the exemplary baseball game of the preferred embodiment illustrated in FIGS. 1–4, the switches S1 (21*a*), and S2 (21*b*) are pressure sensors (e.g., Radio Shack #275-1571B) that close switches when compressed between their corresponding selected area rigid surface 22*a*, 22*b*, respectively, and the whole area rigid surface 20. The switch S3 (24), is a vibration sensor (e.g., Radio Shack #275-016A) that closes a switch in response to movement, such as vibration, of the target sheet 4 to which it is attached. Internal programming of the processor 32 is structured to ignore the closing of the vibration switch S3 if any of the pressure switches S1, S2 are simultaneously closed. Such programming allows the processor 32 to distinguish between projectile contact with the sheet 4 in the non-selected area 16 as opposed to projectile contact with the selected areas 1, 2, which contact may also cause vibration of the sheet 4.

The processor 32 is preferably programmed to allow automatic operation as follows. While the on-off switch SW1 is switched on, the game 9 functions automatically such that: contacting the target 10 (e.g., triggering the vibration sensor 24) causes the display 3 to be active, and begins a game sequence if the game 9 was in a sleep mode prior to the target 10 being contacted. After a predetermined game score, or at a predetermined time period following a most recent contact of the target 10, the game 9 automatically changes into the sleep mode wherein the display 3 is inactive and the game sequence is assumed to be completed (regardless of score).

Exemplary Sport Games

The processor 32 is internally programmed for specific target-and-projectile games such as target games (e.g., darts) or active sport games (e.g., baseball). Examples of three sport games, baseball, football and soccer, are described as follows.

1. Baseball

Sensors 22 are activated by pressure of a baseball-like projectile 18 striking a Velcro™ covered first selected area 1 (the "catchers glove") over switch S2 (21*b*), or the non-Velcro™ second selected area 2 (the "baseball bat") over switch S1 (21*a*), or optionally the non-selected area 16 (any other part of the target 10) may be activated by a vibration sensor switch S3 (24), as shown in FIG. 1. The scores may appear on an LCD or colored LED alphanumeric display 5, or may simply be announced through a speaker 6 after a predetermined time period, or both. The play action is determined by the position, size and shape of the selected areas 1, 2 and whether or not the vibration sensor 24 is utilized. The following play description assumes three areas 1, 2, 16 of activation, all of which activate a random phrase when struck by the ball 18. The preprogrammed phrases are:

A. Random phrases spoken when switch S2 (sensor 21*b* behind first selected area 1) is closed:
(Each time: Ball-hitting-glove sound precedes the phrase.)
Strike!
Way to hum it in!
Strike three! You're out!
Whatta yah lookin' at batter?
Good heat—fast ball!
Strike Three! Batter—Take a seat!
High and outside! A ball!
Low and inside! A ball!
The third out, (flashing of score changes to other team.)

B. Random phrases spoken when switch S1 (sensor 21*a* behind second selected area 2) is closed:
(Each time: Bat-hitting-ball sound preceding the phrases.)
A base hit!
It's a long fly to center field!
It's OUTTA here!
And that's a—two bagger!
Pop-up fly—You're out!
Foul tip.
Line drive picked off—you're out!
A fly! It's gone!

C. Random phrases spoken when switch S3 (vibration sensor 24) is closed:
Wild Pitch!
You can do it! Concentrate!
Foul ball, out of play!
Ball Four! Batter walks!
Get the ball over the plate!
Whoa! That pitch was wild!
Let's see it in the glove!
Come on, you can get it over the plate!

2. Football

Each time the football 18 hits the hands of a pass receiver (e.g., the first selected area 1), a sequenced phrase calls a touchdown, and the score of six points is added to the total on the scoreboard 5. The score continues to flash with the extra point being added to the six to become seven when it is announced that "the extra point is good!" As long as the same team receives the passes, the score keeps flashing and adding up. When the football is intercepted by the other team, (i.e., the football 18 hits the hands of a defender, second selected area 2) a randomly sequenced phrase is spoken, such as "interception, first down." Then the scoreboard 5 flashes the opposing team's score.

3. Soccer

Soccer could be similarly played with the artwork 12 scene illustrating a goalie in front of a goal with a net. As long as the ball 18 is kicked into the goal, the phrases and scoring reward the home team. If the play is "caught or trapped" by the goalie, the sequenced phrases reflect the goalie's success at a turnover causing future scoring to go for the away team. The scoring will switch back to the home team when the goalie has again "caught or trapped" the ball. The goal is scored when the ball hits the illustrated goal net. The vibration sensor 24 may be used for the goal net. One or more pressure sensitive sensors may be used in selected areas 1, 2 of the goalie's body, such as the hands or feet to catch or trap the ball, thus preventing a goal. The ball may be covered in the loop Velcro™ material and the hands and feet may contain the hook Velcro™ to enhance the drama of the game.

In each of the games of baseball, football or soccer, after a predetermined specified time or specific number of plays or specific score, the game sequence would be ended. The system will then be ready for a new game sequence to begin. The circuit is then reset, ready for a new game sequence.

Any number of sports themes can be illustrated on the target. Some themes may involve accessory equipment, such as a toy hockey stick to propel a toy puck projectile 18 to the target 10 illustrating a "goal net", or a toy golf club to propel a toy golf ball projectile 18 to the target 10 illustrating a "hole" on the "green."

Although the invention has been illustrated and described in detail in the drawings and foregoing description, the same is to be considered as illustrative and not restrictive in character—it being understood that only preferred and exemplary embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A game comprising:

a projectile, being a free object; and a target, comprising a flexible sheet, mountable on a whole-area rigid surface wherein:

the sheet has a front side and a back side;

the front side comprises mural-like artwork illustrating a scene that has one or more selected areas related to scoring or other actions of the game, the selected areas being portions of a total area of the sheet;

attached to the sheet are one or more selected area rigid surfaces that are shaped correspondingly to the one or more selected areas, each of the one or more selected area rigid surfaces being positioned within a corresponding one of the one or more selected areas;

a single sensor is attached behind each of the one or more selected area rigid surfaces;

a non-selected area of the sheet is a portion of the total area that is outside of all of the one or more selected areas;

a single vibration sensor is attached to the non-selected area;

a display is associated with the target; and circuitry connects each sensor and the display with a processor that is preprogrammed such that when the projectile contacts the non-selected area or one of the one or more selected areas, the display responds with feedback signals that are appropriate to the actions of the game, and further such that activation of the vibration sensor is interpreted as projectile contact with the non-selected area only if there is no concurrent activation of a selected area sensor.

2. A game as defined in claim 1, wherein:

the sensor attached behind one of the one or more selected area rigid surfaces detects when the projectile contacts the corresponding selected area by being compressed between the one of the one or more selected area rigid surfaces and the whole-area rigid surface.

3. A game as defined in claim 1, wherein:

the feedback signals are audible sounds which inform a player about a game-related consequence of the projectile contacting one of the one or more selected areas.

4. A game as defined in claim 3, wherein:

the audible sounds are spoken words.

5. A game as defined in claim 3, wherein:

the audible sounds are the buzz of a buzzer.

6. A game as defined in claim 1, wherein:

the feedback signals are visual effects which inform a player about a game-related consequence of the projectile contacting the target.

7. A game as defined in claim 6, wherein:

the visual effects are a scoreboard display with numeric scores.

8. A game as defined in claim 1, wherein the processor is further preprogrammed such that:

for each one of the one or more selected areas, when contacted by the projectile, a specific feedback signal is displayed that is unique to the one of the one or more selected areas.

9. A game as defined in claim 1, wherein the processor is further preprogrammed such that:

for each one of the one or more selected areas, when contacted by the projectile, a specific feedback signal is displayed such that the specific feedback signal is selected from a bank of feedback signals according to a predetermined sequential pattern.

10. A game as defined in claim 1, wherein:

the feedback signals include simulated sounds of fireworks exploding; and the sounds can be used to indicate the conclusion of a time of playing the game.

11. A game as defined in claim 1, wherein:

the display is attached to the perimeter of the target.

12. A game as defined in claim 1, wherein:

the scene depicts a sport that involves a projectile.

13. A game as defined in claim 12, wherein:

the scene depicts at least one character associated with the sport.

14. A game as defined in claim 12, wherein:

the projectile simulates a projectile chosen from the group consisting of a baseball, a football, a basketball, a soccer ball, a tennis ball, a table tennis ball, a golf ball, and a hockey puck.

15. A game as defined in claim 1, wherein:

the projectile is made safe for indoor play.

16. A game as defined in claim 1, wherein:

at least a portion of the back side of the sheet has adhesive material thereon, for mounting the target on the whole-area rigid surface;

the whole-area rigid surface is a wall; and the adhesive material removably adheres to the wall without additional fasteners and without damaging the wall.

17. A game as defined in claim 1, wherein:

at least a portion of the back side of the sheet has adhesive material thereon, for mounting the target on the whole-area rigid surface; and the whole-area rigid surface is a stiff portable surface that is either hand held or free standing.

18. A game as defined in claim 1, wherein:

the sheet comprises a first layer having a first planar area, and a second layer having a second planar area;

the first planar area is larger than the second planar area;

the first layer has an adhesive backing; and the second layer is adhered to the adhesive backing such that a portion of the adhesive backing around the perimeter of the second layer is uncovered by the second layer, thereby providing a means for mounting the target on the whole-area rigid surface.

19. A game as defined in claim 18, wherein:

the first layer is a transparent flexible material; and the second layer is a flexible material having a portion of the artwork on the side adhered to the adhesive backing of the first layer.

20. A game as defined in claim 1, wherein:

the projectile is at least partly covered with a first attachment means; and at least a portion of the front side of the sheet is covered with a second attachment means that matingly corresponds to the first attachment means.

21. A game as defined in claim 20, wherein:

the first attachment means is loop-threaded material; and the second attachment means is hook-threaded material.

22. A game as defined in claim 20, wherein:

the second attachment means covers an area within one of the one or more selected areas.

23. A game as defined in claim 1, further comprising an on-off switch, wherein the processor is further preprogrammed such that while the on-off switch is switched on, the game functions automatically such that:

contacting the target causes the display to be active, and begins a game sequence if the game was in a sleep mode prior to the target being contacted; and after a predetermined game score, or at a predetermined time period following a most recent contact of the target, the game automatically changes into the sleep mode wherein the display is inactive and the game sequence is assumed to be completed.

* * * * *